US005878687A

United States Patent [19]

Grimmeisen

[11] Patent Number: 5,878,687

[45] Date of Patent: Mar. 9, 1999

[54] BOAT FOR DIVERS

[76] Inventor: Jurgen Grimmeisen, Rennstrasse 8, D-70499 Stuttgart, Germany

[21] Appl. No.: 913,999

[22] PCT Filed: Apr. 1, 1996

[86] PCT No.: PCT/DE96/00568

§ 371 Date: Mar. 9, 1998

§ 102(e) Date: Mar. 9, 1998

[87] PCT Pub. No.: WO96/30087

PCT Pub. Date: Oct. 3, 1996

[30] Foreign Application Priority Data

Mar. 31, 1995 [DE] Germany ..... 195 11 850.2

[51] Int. Cl.[6] ..... B63C 11/46

[52] U.S. Cl. ..... 114/315; 440/6

[58] Field of Search ..... 114/312, 313, 114/315, 332, 331, 121, 122, 123, 125; 441/65; 440/6

[56] References Cited

U.S. PATENT DOCUMENTS

| | | | |
|---|---|---|---|
| 4,864,959 | 9/1989 | Takamizawa et al. | 114/315 |
| 4,996,938 | 3/1991 | Cameron et al. | 114/315 |
| 5,568,783 | 10/1996 | Ditchfield | 114/315 |

FOREIGN PATENT DOCUMENTS

| | | | |
|---|---|---|---|
| 9200124 | 1/1992 | WIPO | 114/315 |

*Primary Examiner*—Stephen Avila
*Attorney, Agent, or Firm*—Edwin E. Greigg; Ronald E. Greigg

[57] ABSTRACT

A boat for divers comprising a hull in which there is a flow channel with a propulsion screw. The hull includes a flow channel for the water, an electric motor and control devices for the motor and the bow of the hull has a hydrodynamic configuration.

20 Claims, 1 Drawing Sheet

BOAT FOR DIVERS

This application is a 371 of PCT/DE96/00568, filed Apr. 1, 1996.

PRIOR ART

The invention is based on a motorized watercraft. Motor-driven watercraft belong to the group of motor-driven water craft in which the person steering the water craft is pulled on or under the surface of the water with the aid of the watercraft. The watercraft serves as a means of moving the swimmer and diver forward and is also known as a wet-diving boat, since the swimmer or diver is not seated in an extra cabin or on the craft but rather is in direct contact with the water.

In a known motorized watercraft (German Utility Model DE-GM 90 05 333), a cylindrical main body is provided, in which the battery and other control parts are disposed and on whose stern an annular body is disposed, in which both the motor and the propeller are disposed. This contrivance can be used both to propel an inflatable boat and a single person; not only in the case of direct drive, the flow of water generated by the annular body impacts upon the person to be transported.

In another known "watercraft for bathers" (German Patent DE 880 565), the bather is dragged in the wake of the watercraft. Steering of the watercraft by the bather is possible only with difficulty, especially since the bather is fully exposed to the resistance of the water, and in addition the water flow generated by the drive device impacts upon the bather.

By comparison, a known motorized watercraft of this generic type (U.S. Pat. No. 5,158,034) has a flat platform on which the person lies on his stomach. The drive device, located in a flow bell, is disposed on the underside of the platform. The person steering the device is exposed to the full flow of the wake during diving trips.

In another known underwater craft (French Patent Disclosure FR 1 584 195), the diver again lies on his stomach on the device. To protect him here at least a little against the flow of the wake, a transparent guard bell can be mounted on the device that protects the head of the diver from the flow. Drive units are releasably disposed on the underside of the platform.

In another known float body for underwater sport (German Patent Disclosure DE 30 06 613), the underwater drive unit is disposed, protected against the flow of the wake, on the underside of the float body. In this device as well, while diving, the bather in contrast to the drive unit is fully exposed to the flow of the wake.

It is true that in some known watercraft of another generic type (U.S. Pat. No. 4,971,584), for propulsion on the surface of the water only, the drive unit is disposed in the hull of the watercraft, and the drive propeller is located in a flow channel disposed in the hull. With these so-called waterbikes, diving is not possible.

THE INVENTION AND ITS ADVANTAGES

The motorized watercraft of the invention has the advantage over the prior art that the flow of water aspirated by the propeller is carried largely in laminar fashion through the propeller flow channel disposed in the hull. Through the flow channel, the water flow generated by the propeller is then carried in such a way that on the one hand it does not strike the body of the person and on the other is guided slightly downward, thus making depth control of the watercraft simpler.

Another advantage of the invention is that the motor and the control units are disposed above the flow channel in the hull, which provides a favorable distribution of weight, so that the person lying at least partially on the motorized watercraft can easily steer the watercraft, since the drive flow extends eccentrically to the center of gravity, so that the body weight of the person can more easily be employed for steering.

Another advantage of the invention is that by means of the hydrodynamic configuration disposed on the bow of the hull, in combination with the flow channel disposed in the hull, the flow of the wake is largely made to bypass the person steering the watercraft during diving trips.

In an advantageous feature of the invention, the electric motor is disposed in the hull outside the flow channel. Such an arrangement has the advantage that no unnecessary turbulence and resistance in the water flow, which have a disadvantageous effect on the efficiency of the drive, are created in the flow channel by drive devices located there.

In a further advantageous feature of the invention, the battery is disposed in a separate, removable container secured to the hull. Such an arrangement has the advantage that the batteries can be replaced quickly and easily as needed.

In a further advantageous feature of the invention, the container containing the battery, which is removable in the direction of travel of the watercraft, is disposed on the underside of the hull. The electrical connection of the battery to the control unit is effected via a plug connection between the underside of the hull and the top side of the container. Such an arrangement assures a safe and easily removable fastening of the container to the hull.

In a further advantageous feature of the invention, the handles and hull are embodied ergonomically, to enable steering the motorized watercraft in an easy and convenient way in conjunction with the person (in particular by means of his shifting his weight).

In a further advantageous feature of the invention, the free spaces in the hull are at least partly filled with foam. For instance if the motorized watercraft is released by the person, it would automatically float to the surface of the water.

In a further advantageous feature of the invention, a float bladder is also present, whose volume can be increased or decreased as needed for descending and ascending during diving. This provision for the diver's benefit is especially advantageous because the diver at least partly lies on the motorized watercraft rather than merely being dragged behind it.

In a further advantageous feature of the invention, a cable pocket accessible from outside and sealed off on the inside is disposed in the housing.

In a further advantageous feature of the invention, louvers or grids for screening out foreign objects are present upstream of the propeller in the flow channel. Such objects are expected to be above all fish but also films or foils floating in the water, or the like. Thus according to the invention a bypass channel may be provided that bypasses the propeller, so that without major loss of flow such objects can be made to bypass the boat.

In a further advantageous feature of the invention, the device controlling the rpm is set immediately to zero rpm if the person releases the handle (2). It is thus achieved above all that if the diver loses the motorized watercraft, the motorized watercraft will automatically discontinue its travel.

In a further advantageous feature of the invention, the shaft of the propeller is disposed in a bearing block, which is secured to the wall of the flow channel via radial struts. In this way, the bearing of the propeller and of the electric motor are secured completely separately from one another on the housing.

In a further advantageous feature of the invention, the shaft of the propeller is guided in a pipe, which in sealed fashion penetrates the wall of the flow channel in the region of the curvature at a certain angle and on the other end is sealingly secured to the bearing block. It is attained as a result that the shaft of the propeller, which during normal travel extends approximately in the direction of travel, effects an aspiration of the water into the flow channel, the aspiration extending approximately in the flow direction, while the exiting of the water because of the slightly downward-pointing curvature, above all compensates for the weight of the diver lying on the watercraft.

In a further advantageous feature of the invention, a transmission, which is preferably a belt drive or gear-wheel transmission, is present between the shafts of the propeller and of the electric motor and is disposed inside the housing.

In a further advantageous feature of the invention, indicator devices for battery charging, dive depth and the like are disposed within viewing range of the diver on the jacket face of the hull, in order to inform the diver in a clear way of certain data.

Further advantages and advantageous features of the invention may be learned from the ensuing description, drawing and claims.

BRIEF DESCRIPTION OF THE DRAWING

An exemplary embodiment of the subject of the invention is shown in the drawing and described in further detail below. Shown are.

DESCRIPTION OF THE EXEMPLARY EMBODIMENT

Figure 1:
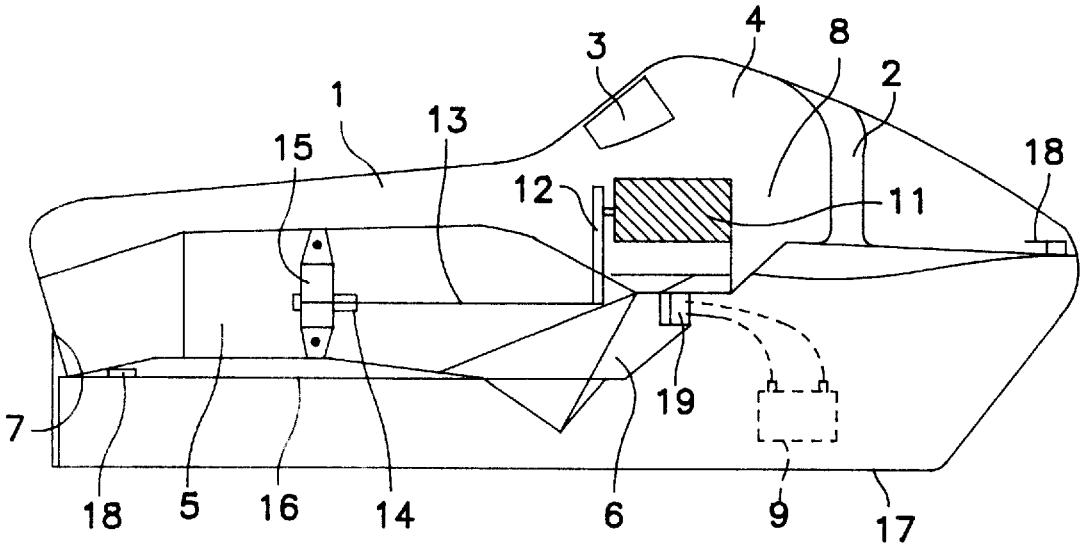
FIG. 1, a motorized watercraft, in a simplified, partly transparent, side view.

FIG. 1 shows a motorized watercraft of the invention in a side view; the diver or swimmer at least partly lies on the top of the hull 1 and holds onto handles 2 disposed on both sides of the hull. Measuring instruments 3 are disposed in the jacket face of the top of the hull 1, in the forward portion where the diver can seem them, examples being a battery charge indicator, depth meter, or the like. A device that controls the speed, such as a lever or the like that can be operated directly by the diver is disposed on at least one of the handles 2 but not shown. Moreover, the hull is embodied as hydrodynamically as possible, and in particular it has a hydrodynamic configuration 4 that diverts the flow of the wake around the person steering the water craft. From the transparent illustration it can be seen that a flow channel 5 is disposed in the hull, with an inlet opening 6 located in the forward region of the hull 1 and an outlet opening 7 located on the stern end of the hull. This flow channel 5 is sealed off from the remainder of the interior 8 of the hull 1.

In addition to electrical control units not shown, an electric motor 11 and a transmission 12 are disposed in the interior of the hull; the transmission actuates a shaft 13, extending in the flow channel, which is disposed there in a bearing 14 and actuates a propeller 15. The batteries 9 are located in the container 17 disposed on the underside 16 of the hull. The container 17 is secured to the hull in the flow direction by means of a fastening device 18. Via the plug connection 19, the electrical control unit system is connected to the battery current.

The driver allows himself to be pulled by the motorized watercraft by holding fast to the handles 2 and from there controlling the rpm of the propeller 15; for propulsion, water is aspirated into the flow channel 5 through the inlet opening 6 and is pumped out again via the outlet opening 7, thus propelling the motorized watercraft in the water. Both the inlet opening 6 and the outlet opening 7 are secured by means of louvers or grids in such a way that a direct access to the impeller propeller is not possible. For steering the motorized watercraft, the handles 2 are used primarily, by way of which the diver attains a relative change of position of his body with respect to the motorized watercraft, thereby making the motorized watercraft steerable. However, it is also possible to equip the motorized watercraft with steering fins, which can then be controlled either manually or electrically.

Figure 2:
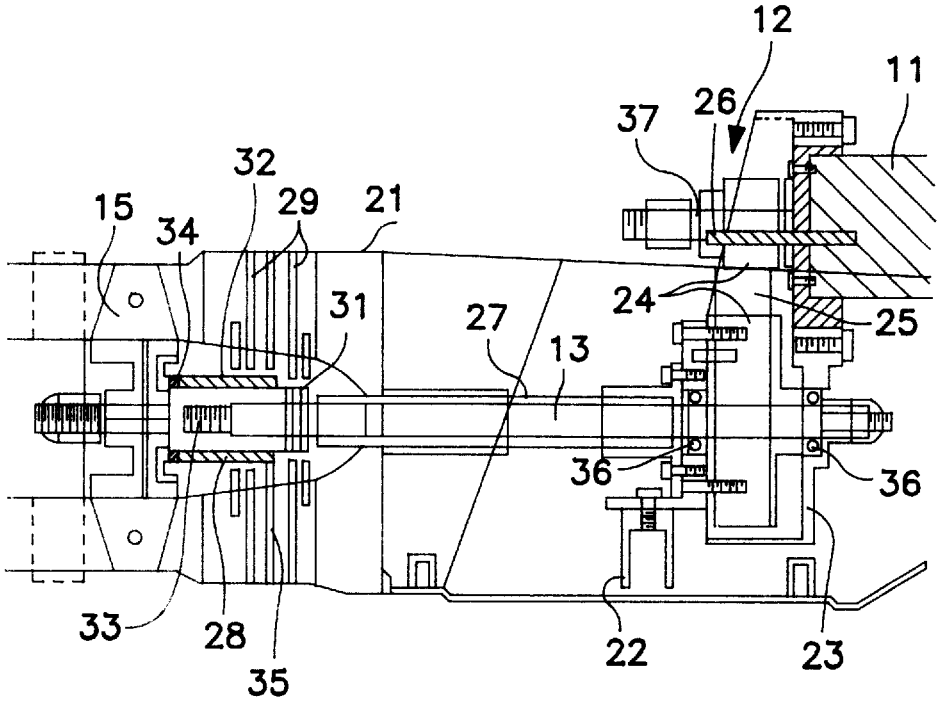
FIG. 2, a longitudinal section through part of the motorized watercraft.

In FIG. 2, the drive portion of the motorized watercraft is shown on a larger scale compared to FIG. 1. A metal plate 22 is laminated with the top of the channel wall 21; it carries a frame 23 on which the electric motor 11 is disposed on one side and the transmission 12 on the other. The transmission has two pulleys 24 of different diameter, in order to step down the high rpm of the motor 11 to the requisite low rpm of the propeller 15. A belt 25 is used to change the rpm. A coupling 26 is disposed between the electric motor 13 and the transmission 12. The shaft 13 is guided on its passage through the channel wall 21 in a pipe 27, which is well sealed off, on its outer jacket, from the channel wall 21 and leads to a bearing block 28 of the bearing 14, which is secured to the channel wall 21 via radial struts 29. Provided in this bearing block 28 are on the one hand ball bearings 31 for the shaft 13 as well as needle bearings 32 for a shaft bolt 33, which is connected to the shaft 13 in a manner fixed against relative rotation and to which the propeller 15 is secured. The connecting point between the pipe 27 and the bearing block 28 is embodied in a sealing manner. Moreover, a dynamic seal 34 is provided between the shaft bolt 33 and the bearing block 28. Via a lubricant line 35, the two bearings 31 and 32 can be provided with lubricant. On the side remote from the propeller 15, the shaft 13 is supported on ball bearings 36, which are disposed in the frame 23. For the sake of easy running, ball bearings are also provided for supporting the upper transmission shaft 32.

All the characteristics addressed in the specification and the ensuing claims and shown in the drawing may be essential to the invention both individually and in any arbitrary combination with one another.

LIST OF REFERENCE NUMERALS

1 hull
2 handles
3 measuring instruments
4 hydrodynamic configuration
5 flow channel
6 inlet opening
7 outlet opening
8 interior
9 battery
10

11 electric motor
12 transmission
13 shaft
14 bearing
15 propeller
16 underside of hull
17 battery holder
18 fastening device
19 plug connection
20
21 channel wall
22 metal plate
23 frame
24 pulleys
25 belt
26 coupling
27 pipe
28 bearing block
29 struts
30
31 ball bearing
32 needle bearing
33 shaft bolt
34 seal
35 lubricant line
36 ball bearing
37 upper shaft

I claim:

1. A motorized watercraft, comprising a hydrodynamically embodied hull (1), a flow channel (5) disposed in the hull, and extending largely in a longitudinal direction and through which water flows, wherein the flow channel upstream has an inlet opening in a forward half of the hull that is curved slightly in a direction of an underside of the hull; and downstream has an outlet opening on the stern that is lightly curved in a direction of the underside of the hull, a propeller (13), in the flow channel (3) which serves the watercraft, an electric motor (8), coupled to the propeller (13), a control unit for controlling the electric motor, an energy source including an electric battery (7), handles (2), disposed on opposite sides of the hull (1), for the person steering the motorized watercraft, a device on at least one of the handles for controlling the rpm of the propeller (13), the handles are disposed in a forward to a middle region of the hull, a person for steering the motorized watercraft lies at least partly on the motorized watercraft, the bow of the hull has a hydrodynamic configuration that guides a water flow largely past the person, the battery is disposed in a separate, removable container secured to the hull, and the handles (2) and hull are embodied ergonomically, to enable steering the motorized watercraft in conjunction with the person.

2. The motorized watercraft in accordance with claim 1, in which the container containing the battery is disposed on an underside portion of the hull; that the container is removable in a direction of travel of the watercraft; and that the electrical connection of the container and the battery is effected via a plug connection between the underside portion of the hull and the top side of the container.

3. The motorized watercraft in accordance with claim 1, in which the electric motor is disposed in the hull portion outside the flow channel.

4. The motorized watercraft in accordance with claim 2, in which the electric motor is disposed in the hull portion outside the flow channel.

5. The motorized watercraft in accordance with claim 1, in which the free spaces (6) in the hull (1) are at least partly filled with foam.

6. The motorized watercraft in accordance with claim 2, in which the free spaces (6) in the hull (1) are at least partly filled with foam.

7. The motorized watercraft in accordance with claim 3, in which the free spaces (6) in the hull (1) are at least partly filled with foam.

8. The motorized watercraft in accordance with claim 4, in which the free spaces (6) in the hull (1) are at least partly filled with foam.

9. The motorized watercraft in accordance with claim 1, in which a float bladder is connected to the hull (1), and a volume of the float bladder can be increased or decreased as needed for descending and ascending during movement of the boat.

10. The motorized watercraft in accordance with claim 2, in which a float bladder is connected to the hull (1), and a volume of the float bladder can be increased or decreased as needed for descending and ascending during movement of the boat.

11. The motorized watercraft in accordance with claim 3, in which a float bladder is connected to the hull (1), and a volume of the float bladder can be increased or decreased as needed for descending and ascending during movement of the boat.

12. The motorized watercraft in accordance with claim 4, in which a float bladder is connected to the hull (1), and a volume of the float bladder can be increased or decreased as needed for descending and ascending during movement of the boat.

13. The motorized watercraft in accordance with claim 1, in which a cable pocket accessible from outside said hull and sealed off on an inside is disposed in the hull (1).

14. The motorized watercraft in accordance with claim 1, in which louvers for filtering out foreign objects are present upstream of the propeller (13) in the flow channel (3).

15. The motorized watercraft in accordance with claim 1, in which the device controlling the rpm is set immediately to zero rpm if the person releases rpm control of the handle (2).

16. The motorized watercraft in accordance with claim 1, in which the shaft (11) of the propeller (13) is disposed in a bearing block (22), which is secured to a wall (14) of the flow channel (5) via radial struts (23).

17. The motorized watercraft in accordance with claim 16, in which the shaft (11) of the propeller (13) is guided in a pipe (21), which in sealed fashion penetrates the wall (14) of the flow channel (5) in the region of a curvature at a certain angle and on the other end is sealingly secured to the bearing block (22).

18. The motorized watercraft in accordance with claim 16, in which a transmission (9) belt drive or gear-wheel transmission is present between the shafts of the propeller (13) and of the electric motor (8).

19. The motorized watercraft in accordance with claim 17, in which a transmission (9) belt drive or gear-wheel transmission is present between the shafts of the propeller (13) and of the electric motor (8).

20. The motorized watercraft in accordance with claim 1, in which indicator devices for battery charging, dive depth and the like are disposed within viewing range of the diver on the jacket face of the hull (1).

* * * * *